US007063323B1

(12) United States Patent
Khodabandeh

(10) Patent No.: US 7,063,323 B1
(45) Date of Patent: Jun. 20, 2006

(54) POLITICAL CHESS GAME

(76) Inventor: Majid Khodabandeh, 7677 Ironbridge Ct., Florence, KY (US) 41042

( * ) Notice: Subject to any disclaimer, the term of this patent is extended or adjusted under 35 U.S.C. 154(b) by 0 days.

(21) Appl. No.: 10/954,088

(22) Filed: Sep. 29, 2004

(51) Int. Cl.
*A63F 3/00* (2006.01)

(52) U.S. Cl. ..... 273/260; 273/262

(58) Field of Classification Search ..... 273/260, 273/261, 255, 262
See application file for complete search history.

(56) References Cited

U.S. PATENT DOCUMENTS

D134,342 S 11/1942 Fieldz
5,421,582 A 6/1995 Ritter
5,511,793 A * 4/1996 Watt ..... 273/260
5,642,885 A 7/1997 Gustin
5,690,334 A 11/1997 Duke
5,692,754 A 12/1997 Rostami
5,735,523 A 4/1998 Fioriglio
5,749,583 A 5/1998 Sadounichvili et al.
5,954,333 A 9/1999 Vilches Guerra
6,799,763 B1 * 10/2004 Grady ..... 273/260

* cited by examiner

*Primary Examiner*—Vishu K. Mendiratta

(57) ABSTRACT

A political chess game includes a game board and two sets of game pieces, each set including a standard set of game pieces from a standard chess game and an auxiliary set of political game pieces. Each of the standard game pieces operate according to rules governing play of a standard chess game. The auxiliary set includes Orientals, Camels, Donkeys, and Elephants. Each of the auxiliary game pieces operate according to rules governing play for Kings and the Queens. The game board defines sixteen parallel and adjacent rows of the squares. Each row is colored by one of a first color, a second color, a third color, a fourth color and a fifth color with the colors defining an alternate cultural group.

4 Claims, 2 Drawing Sheets

POLITICAL CHESS GAME

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a chess game and, more particularly, to a modified chess game including game pieces depicting political groups from around the world.

2. Prior Art

A traditional chess game set, for perhaps over 2000 years, has deployed 32 chess pieces, in two opposing sides of 16 pieces each confronting each other, movable over a game board having 64 squares arranged in 8 rows and 8 columns. Traditional rules have remained unchanged since the origin of this game.

Other chess-like games have been created, derived from the original one, by fundamentally adding a higher number of players, with a layout in triangle and with access on all four sides in order to enable four players to simultaneously participate. But the game then loses its character as a game wherein two players are in direct confrontation.

Given the old character of a chess game with the limitations imposed by its board having 64 squares at 8 squares per side, it has led to some stiffness in the evolution possibilities of the game, which is conditioned by the highly developed opening theory. Thus, starting from a given knowledge level, success possibilities are reduced or practically disappear unless a series of moves are made, especially at the beginning of the game, according to the moves made by the opponent.

During the year 1997, computer software was proven to be capable of defeating the present world chess champion in a six-round tournament. This ratifies the limitations of the traditional game as well as the progressive lack of alternatives and creativity in this game, as it allows for programming the best possible move in every situation.

Numerous variations of the standard chess game have been proposed both as means of increasing the complexity of the game and as means of simplifying the game. The prior art discloses a chess set utilizing two entire sets of standard chess pieces. That game was designed for use by four players. Thus, in that game, one player only controls one set of standard chess pieces. While doubling the number of players involved probably does increase the complexity of the game, each player still needs only to keep track of one set of 16 pieces.

However, because this game involves four players, it distorts the normal adversarial relationship of standard chess. Players may find themselves forming alliances with other players, or having opposing players forming alliances against them. Furthermore, normal strategy, which involves occasional trading of equivalent pieces, or sacrificing of less valuable pieces to capture more valuable ones is distorted because players trading equivalent pieces may find themselves in weaker positions in relation to the other players.

The prior art further discloses a chess-like board game employing 62 game pieces rather than the standard 32. However, fourteen of those pieces are "boat" pieces, which are completely foreign to standard chess. Furthermore, the board contains a number of squares designated as "water" on which the standard chess pieces may move only if they do so in conjunction with a "boat" piece. This game therefore, departs so far from standard chess so as to render the strategies employed in it almost irrelevant with regard to improving one's chess abilities.

These other chess-type games either alter the rules of chess so much as to render the game almost irrelevant to improving chess abilities, or they simplify the rules in an effort to accommodate beginners. In neither type of game do the participants get both increased complexity and relevance to standard chess strategies, thus allowing participants to improve their chess abilities while enjoying a unique variation of the standard game.

Accordingly, a need remains for a modified chess game that is challenging as well as a useful in teaching new players. The present invention satisfies such a need by providing an attractive, modified game board that increases strategy and movement possibilities without substantially altering the original rules of chess. Additional game pieces are designed to represent different political groups from around the world, which may increase one player's sense of domination over the other player.

BRIEF SUMMARY OF THE INVENTION

In view of the foregoing background, it is therefore an object of the present invention to provide a political chess game for use by a first player against a second player. These and other objects, features, and advantages of the invention are provided by a game board with an upper surface and a rectangular shape including a plurality of squares over which the game pieces move.

Advantageously, the present invention further includes a plurality of game pieces including a first and a second set of game pieces respectively used by the first player and the second player for playing the political chess game on the game board with each set of game pieces including a standard set of game pieces from a standard chess game and an auxiliary set of political game pieces.

The standard game piece set preferably includes a plurality of Kings, a plurality of Queens, a plurality of Rooks, a plurality of Knights, a plurality of Bishops and a plurality of Pawns. Each of the standard game pieces operate according to all rules governing play of a standard chess game. The auxiliary game piece set preferably includes a plurality of Orientals, a plurality of Camels, a plurality of Donkeys and a plurality of Elephants. Each of the auxiliary game pieces operate according to rules governing play for the Kings and the Queens.

Such an auxiliary game piece set includes at least one new game piece. Each of the new game pieces moves on the board according to an amount equal to one of the squares away from the square that the new game piece is resting on. The new game pieces may move in one direction chosen from the group of a forward motion, a backward motion, a left motion, a right motion, and a diagonal motion.

The game board defines sixteen parallel and adjacent rows of the squares. Each row includes an equal quantity of the squares and each of the squares is colored by one of a first color, a second color, a third color, a fourth color and a fifth color. Each the colors define an alternate cultural group according to a person's origin of birth. Selected ones of the rows are preferably provided with surface indicia for defining a starting position of the first and the second game piece sets respectively.

The game board preferably includes a central portion including selected ones of the squares that have one of the first color, the second color, the third color and the fourth color such that juxtaposed ones of the selected squares are uniquely colored in altering patterns. The game board may also include a plurality of lateral portions oppositely juxtaposed with the central portion wherein other ones of the squares have one of the first color and the fifth color. Additionally, the game board may advantageously be provided with background indicia for mapping world continents along a 2-dimensional plane.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
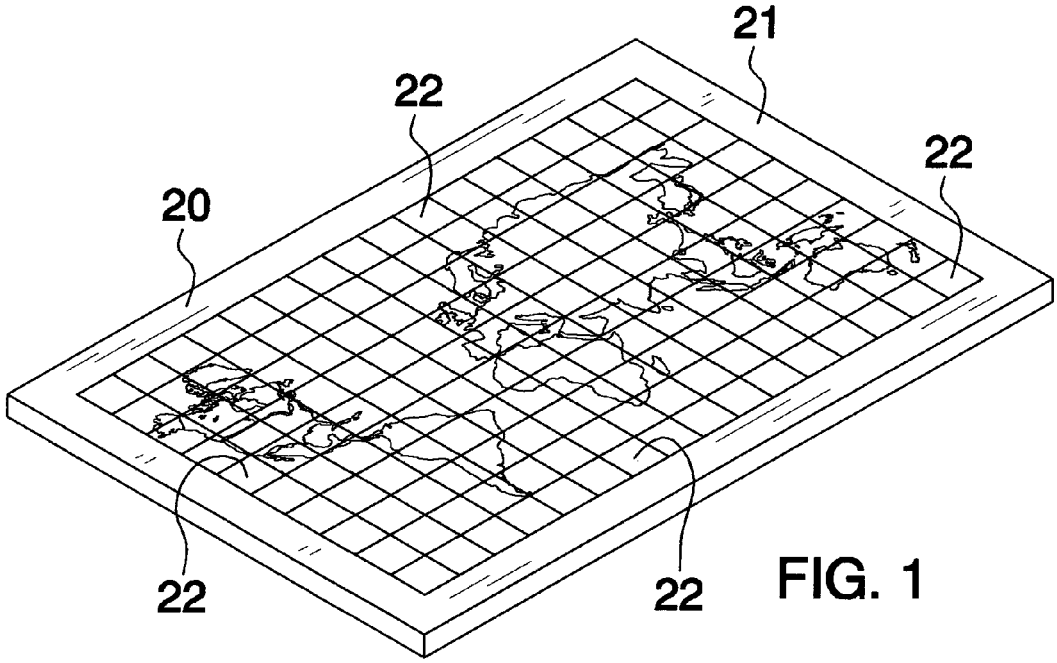
FIG. 1 is a perspective view showing a modified game board for a political chess game, in accordance with the present invention.
Figure 2:
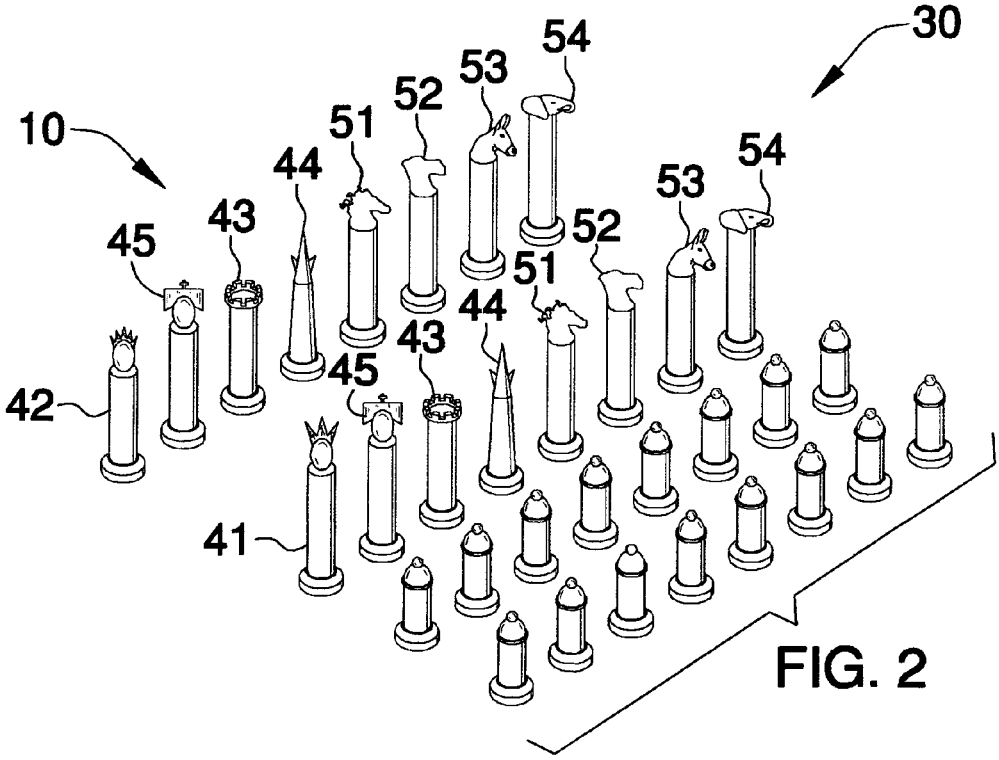
FIG. 2 is a perspective view showing the standard and auxiliary game piece sets.
Figure 3:
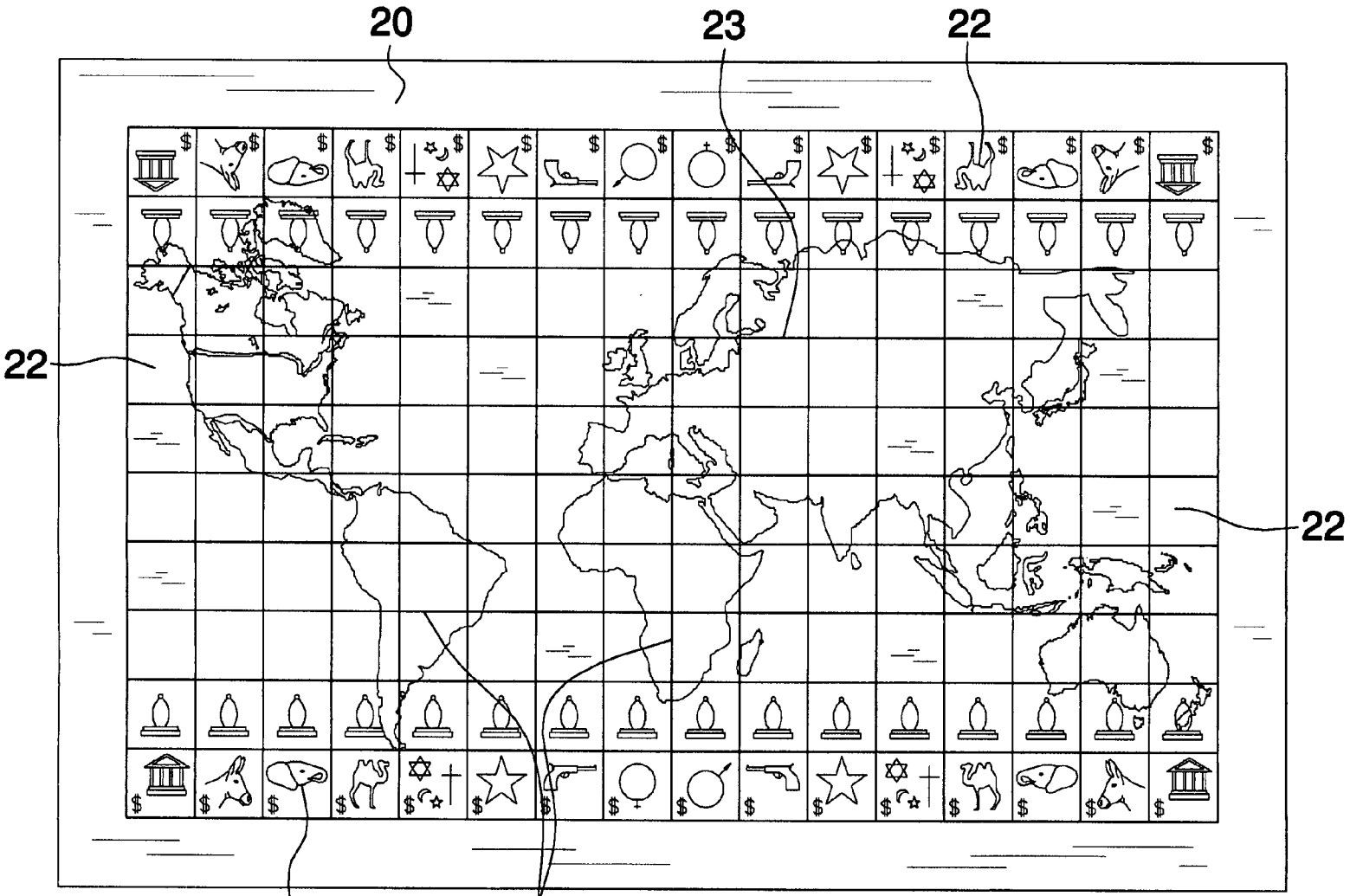
FIG. 3 is a top plan view of the modified game board shown in FIG. 1.

The apparatus of this invention is referred to generally in FIGS. 1–3 by the reference numeral 10 and is intended to challenge experienced chess players and entice new players with a modified game board and playing pieces. It should be understood that the apparatus 10 may be played by chess enthusiasts of any age or skill level.

Referring initially to FIG. 1, the apparatus 10 includes a game board 20 with an upper surface 21 and a rectangular shape including a plurality of squares 22 over which the game pieces 30 move.

Now referring to FIG. 2, the present invention advantageously includes a plurality of game pieces 30 including a first and a second set of game pieces respectively used by the first player and the second player for playing the political chess game 10 on the game board 20 with each set of game pieces 30 including a standard set of game pieces from a standard chess game and an auxiliary set of political game pieces.

Continuing to refer to FIG. 2, the standard game piece set preferably includes a plurality of Kings 41, a plurality of Queens 42, a plurality of Rooks 43, a plurality of Knights 44, a plurality of Bishops 45 and a plurality of Pawns 46. Each of the standard game pieces operate according to all rules governing play of a standard chess game. The auxiliary game piece set preferably includes a plurality of Orientals 51, a plurality of Camels 52, a plurality of Donkeys 53 and a plurality of Elephants 54. Each of the auxiliary game pieces operate according to rules governing play for the Kings 41 and the Queens 42.

Such an auxiliary game piece set includes at least one new game piece. Each of the new game pieces moves on the board 20 according to an amount equal to one of the squares 22 away from the square 22 that the new game piece is resting on. The new game pieces may move in one direction chosen from the group of a forward motion, a backward motion, a left motion, a right motion, and a diagonal motion.

The game board 20 defines sixteen parallel and adjacent rows of the squares 22. Each row includes an equal quantity of the squares 22 and each of the squares 22 is colored by one of a first color, a second color, a third color, a fourth color and a fifth color (not shown). Each the colors define an alternate cultural group according to a person's origin of birth. Selected ones of the rows are preferably provided with surface indicia for defining a starting position of the first and the second game piece sets respectively (not shown).

Now referring to FIG. 3, the game board 20 preferably includes a central portion (not shown) including selected ones of the squares that have one of the first color, the second color, the third color and the fourth color such that juxtaposed ones of the selected squares are uniquely colored in altering patterns. The game board 20 may also include a plurality of lateral portions (not shown) oppositely juxtaposed with the central portion wherein other ones of the squares 22 have one of the first color and the fifth color. Additionally, the game board 20 may advantageously be provided with background indicia 23 for mapping world continents along a 2-dimensional plane.

Action, skill, board, card, and strategy games all offer opportunities for social interaction, an acceptable outlet for competitive feelings, a way to develop skills, the process of decision making, and a means of contributing to the participant's self-worth. The modified board and pieces increase strategy and movement possibilities, thus increasing the excitement of the game. Furthermore, the board is attractive and unique to play on.

The best mode of the present invention is illustrated in FIG. 3, wherein rows 50–53 are colored with the first, second, third fourth and fifth colors, respectively. Rows 54–57 are also colored with the first, second, third fourth and fifth colors, respectively. Such group of rows 50–53 and 54–57 are significant and critical to the present invention for identifying the standard set of chess pieces in a conventional chess game. There are two groups of four rows 46–49 and 58–61 disposed on opposite sides of rows 50–53 and 54–57 respectively. Such row groups 46–49 and 58–61 have black and white colors, which are not the same as any of the first, second, third fourth and fifth colors, respectively. Applicant notes, it is not important what group of colors are chosen as long as the first, second, third fourth and fifth colors are different from the two groups of four rows 46–49 and 58–61. Therefore, no specific color shading has been shown on the game board 20 for the purposes of explaining the true scope and spirit of the present invention.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A political chess game for use by a first player against a second player, said chess game comprising:

a game board having an upper surface for playing said political chess game, said upper surface having a rectangular shape comprising a plurality of squares over which said game pieces move; and a plurality of game pieces comprising a first and a second set of game pieces respectively used by the first player and the second player for playing said political chess game on said game board with each set of game pieces including a standard set of game pieces from a standard chess game and an auxiliary set of political game pieces, said auxiliary game piece set including at least one new game piece for playing said political chess game on said game board, each said new game piece having a movement on said game board defined by moving an amount equal to one of said squares away from a square that said new game piece is resting on in one direction of a forward motion, a backward motion, a left motion, a right motion, and a diagonal motion;

wherein said game board defines sixteen parallel and adjacent rows of said squares, each row including an equal quantity of said squares, each of said squares being colored by one of a first color, a second color, a third color, a fourth color and a fifth color; said game board further comprising, a central portion including selected ones of said squares having one of said first color, said second color, said third color and said fourth color such that juxtaposed ones of said selected squares are uniquely colored in altering patterns; and a plurality of lateral portions oppositely juxtaposed with said central portion wherein other ones of said squares have one of said first color and said fifth color.

2. The chess game of claim 1, wherein said standard game piece set comprises: a plurality of Kings, a plurality of Queens, a plurality of Rooks, a plurality of Knights, a plurality of Bishops and a plurality of Pawns, each said standard game piece operating according to all rules governing play of a standard chess game;

said auxiliary game piece set comprises a plurality of Orientals, a plurality of Camels, a plurality of Donkeys and a plurality of Elephants, each said auxiliary game piece operating according to rules governing play for said Kings and said Queens.

3. The chess game of claim 1, wherein selected ones of said rows are provided with surface indicia for defining a starting position of said first and said second game piece sets respectively.

4. The chess game of claim 1, wherein said game board is provided with background indicia for mapping world continents along a 2-dimensional plane.

* * * * *